US006437495B1

(12) United States Patent
Akoh et al.

(10) Patent No.: US 6,437,495 B1
(45) Date of Patent: Aug. 20, 2002

(54) COLOR CATHODE RAY TUBE WITH CURVED SHADOW MASK HAVING CENTRAL RECESSED PORTIONS

(75) Inventors: Nobuhiko Akoh, Gumma-ken; Norio Shimizu, Fukaya; Shinichiro Nakagawa, Fukaya; Takuya Mashimo, Fukaya; Masatsugu Inoue, Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/402,479

(22) PCT Filed: Feb. 10, 1999

(86) PCT No.: PCT/JP99/00579

§ 371 (c)(1),
(2), (4) Date: Oct. 13, 1999

(87) PCT Pub. No.: WO99/41764

PCT Pub. Date: Aug. 19, 1999

(30) Foreign Application Priority Data

Feb. 13, 1998 (JP) ..... 10-31291

(51) Int. Cl.[7] ..... H01J 29/80; H01J 29/07
(52) U.S. Cl. ..... 313/402; 313/404; 313/477 R
(58) Field of Search ..... 313/402, 477 R, 313/404

(56) References Cited

U.S. PATENT DOCUMENTS

| | | | | |
|---|---|---|---|---|
| 4,072,876 A | | 2/1978 | Morrell | |
| 4,136,300 A | | 1/1979 | Morrell | |
| 4,162,421 A | | 7/1979 | Morrell | |
| 4,727,280 A | * | 2/1988 | Fujimura | 313/402 |
| 4,950,944 A | * | 8/1990 | Fujimura | 313/407 |
| 5,416,379 A | * | 5/1995 | Inoue et al. | 313/402 |
| 5,631,520 A | * | 5/1997 | Inoue et al. | 313/402 |
| 6,025,676 A | * | 2/2000 | Ohama et al. | 313/477 R |
| 6,043,595 A | * | 3/2000 | Yokoyama et al. | 313/402 |
| 6,225,735 B1 | * | 5/2001 | Nakagawa et al. | 313/407 |

FOREIGN PATENT DOCUMENTS

| | | | |
|---|---|---|---|
| EP | 0924741 A1 * | 3/1998 | H01J/29/07 |
| JP | 57-154750 | 9/1982 | |
| JP | 58-93146 | 6/1983 | |
| JP | 59-217930 | 12/1984 | |
| JP | 60-177534 | 9/1985 | |

* cited by examiner

*Primary Examiner*—Nimeshkumar D. Patel
*Assistant Examiner*—Sikha Roy
(74) *Attorney, Agent, or Firm*—Oblon, Spivak, McClelland, Maier & Neustadt, P.C.

(57) ABSTRACT

A shadow mask of a color cathode-ray tube has a substantially rectangular mask main body and a substantially rectangular mask frame fixed to a skirt portion of the mask main body. The mask main body has a curved effective surface formed with a large number of electron-beam passage apertures and opposing the phosphor screen, a non-aperture portion surrounding the outer periphery of this effective surface, and a skirt portion formed in a bent on the outer periphery of the non-aperture portion. The mask main body has a long axis extending in a horizontal direction and crossing with a tube axis, and a short axis extending in a vertical direction and crossing with both the tube axis and the long axis. The effective surface and the non-aperture portion of the mask main body are formed in a curved surface having a radius of curvature in the short axis direction. At each long side of the mask main body, each end portion of the short axis of the effective surface and the non-aperture portion is recessed from any other adjacent part, in a direction leaving from the phosphor screen along the tube axis. The radius of curvature in a short axis direction near the short axis of the effective surface and the non-aperture portion of the mask main body is smaller than the radius of curvature in the short axis direction at other parts.

9 Claims, 3 Drawing Sheets

COLOR CATHODE RAY TUBE WITH CURVED SHADOW MASK HAVING CENTRAL RECESSED PORTIONS

TECHNICAL FIELD

The present invention relates to a color cathode-ray tube, and relates, more particularly, to a color cathode-ray tube with an increased holding strength of a curved surface of a shadow mask to reduce deviation of beam landing.

BACKGROUND ART

In general, a color cathode-ray tube has a vacuum envelope which includes a substantially rectangular panel having an effective portion formed of a curved surface and a skirt portion provided on the periphery of the effective portion, and a funnel connected to the skirt portion. On the inner surface of the effective portion of the panel is formed a phosphor screen consisting of black non-light emitting substance layers and three-color phosphor layers buried in gap of the black non-light emitting substance layers. Inside the panel is disposed a substantially rectangular shadow mask facing the phosphor screen. Within a neck of the funnel is disposed an electron gun for emitting three electron beams. Inside a large diameter portion of the funnel, there is disposed an inner shield fitted to a mask frame of the shadow mask.

In the color cathode-ray tube, three electron beams emitted from the electron gun are deflected by a magnetic field generated from a deflector mounted on the outside of the funnel, and scan the phosphor screen both horizontally and vertically through the shadow mask, to thereby display a color image.

The shadow mask is for selecting three electron beams emitted from the electron gun to the three-color phosphor layers, and has a substantially rectangular mask main body and a substantially rectangular mask frame fitted to the periphery of the mask main body. The mask main body has a curved effective surface formed with a large number of electron-beam passage apertures and opposing the phosphor screen, a non-aperture portion surrounding the outer periphery of this effective surface, and a skirt portion formed in a bent at almost a right angle with respect to the outer periphery of the non-aperture portion. The mask frame is fitted to the skirt portion of the mask main body. The shadow mask is detachably supported on the panel by engaging wedge-shaped elastic supporting member fixed to the corners of the mask frame with stud pin provided at the corners of the skirt portion of the panel, respectively.

Generally, in order to achieve an image display on the phosphor screen of a color cathode-ray tube without a deviation of color purity, it is necessary to select electron beams so that three electron beams that pass through the electron-beam passage apertures formed on the mask main body of the shadow mask make a correct landing onto the three-color phosphor layers. For this purpose, it is necessary to dispose the shadow mask at a predetermined position with respect to the panel. Particularly, it is necessary to keep the distance (q value) between the inner surface of the effective portion of the panel and the inner surface of the mask main body within a predetermined permissible range of values.

In recent years, a color cathode-ray tube has been desired that the panel is formed in a shape as close to a flat surface as possible by enlarging a radius of curvature of the outer surface of the effective portion of the panel in order to improve visibility. In this case, it is necessary to make larger that radius of curvature of the inner surface of the effective portion, from the viewpoint of the visibility and the strength of the vacuum envelope against the atmospheric pressure. Along with an increase in the radius of curvature of the inner surface of the effective portion, it also becomes necessary to increase the radius of curvature of the effective surface of the mask main body in order to obtain suitable beam landing.

However, the increasing of the radius of curvature of the effective surface of the mask main body lowers the strength for holding the curved surface (hereinafter, referred as a curved surface holding strength) of the shadow mask, and easily causes local deformation of the shadow mask in the process of manufacturing the shadow mask and thermal deformation of the shadow mask in the process of manufacturing a color cathode-ray tube, resulting in a deviation of beam landing which leads to an occurrence of deterioration of color purity. Further, when the color cathode-ray tube is built into a TV set, sound generated from the speaker oscillates the shadow mask, which leads to an easy occurrence of deterioration of color purity.

As a measure for improving the curved surface holding strength of the shadow mask, there has been proposed a technique for providing reinforcing beads on the effective surface of the mask main body in Jpn. Pat. Appln. KOKAI Publication No. 7-161306. However, when reinforcing beads are provided on the effective surface having a large radius of curvature in an attempt to obtain a sufficient curved surface holding strength, stepped portions formed as a result causes a local deviation of the distance between the inner surface of the effective portion of the panel and the effective surface of the mask main body from a permissible range of values for the distance. Accordingly, an image of the stepped portions appear on the screen and this extremely deteriorates the picture quality. To avoid this problem, the limit of the height of the stepped portions formed by the reinforcing beads is usually about 0.1 to 0.2 mm. However, the provision of reinforcing beads of this height on the shadow mask having a large radius of curvature of the effective surface can not sufficiently increase the curved surface holding strength.

DISCLOSURE OF INVENTION

The present invention has been contrived in consideration of the above problems, and its object is to provide a color cathode-ray tube which reduces deviation of beam landing and deterioration of color purity by increasing the curved surface holding strength of the shadow mask.

In order to achieve the above object, a color cathode-ray tube according to the present invention comprises: a vacuum envelope including a panel having a substantially rectangular effective portion, a funnel connected to the panel, and a phosphor screen formed on an inner surface of the effective portion of the panel;

a shadow mask disposed to face the phosphor screen within the vacuum envelope, the shadow mask including a substantially rectangular mask main body having a curved effective surface formed with a large number of electron-beam passage apertures and facing the phosphor screen, a non-aperture portion surrounding an outer periphery of the effective surface, and a skirt portion formed in a bent on an outer periphery of the non-aperture portion; and a substantially rectangular mask frame attached to the skirt portion of the mask main body; and an electron gun arranged within a neck of the funnel, for emitting electron beams to the phosphor screen through the shadow mask.

The mask main body has a long axis extending in a horizontal direction and crossing with a tube axis, and a short axis extending in a vertical direction and crossing with both the tube axis and the long axis, and the effective surface, or the effective surface and the non-aperture portion of the mask main body are formed in a curved surface having a radius of curvature in the short axis direction, and at each long side of the mask main body, an end portion of the short axis of the effective surface or the non-aperture portion is recessed from any other adjacent part, in a direction to leave from the phosphor screen along the tubular axis.

Further, according to the color cathode-ray tube relating to the present invention, the effective surface, or the effective surface and the non-aperture portion of the mask main body are formed in a curved surface having a radius of curvature in the short axis direction, and at each long side of the mask main body, at least one portion at an intermediate part in the long axis direction of the effective surface or the non-aperture portion is recessed from any other adjacent part, in a direction to leave from the phosphor screen along the tubular axis.

Further, according to the color cathode-ray tube relating to the present invention, the effective surface, or the effective surface and the non-aperture portion of the mask main body are formed in a curved surface having a radius curvature in the short axis direction, and at each long side of the mask main body, at least a part of the effective surface and the non-aperture portion at the vicinity of the short axis is recessed from any other part adjacent in the long axis direction, in a direction to leave from the phosphor screen along the tubular axis.

According to the color cathode-ray tube having the above-described structure, the provision of a recess on each of the long sides of the effective surface or the non-aperture portion of the mask main body makes it possible to maintain high-level strength for holding the curved surface of the effective surface of the mask main body even in the case where the radius of curvature of the effective surface of the mask main body has been increased along an increase in the radius of curvature of the external surface of the effective portion of the panel. Therefore, it is possible to provide a color cathode-ray tube which can minimize an occurrence of deterioration of color purity by restricting local deformation of a shadow mask in the process of manufacturing the shadow mask, thermal deformation of the shadow mask in the process of manufacturing the color cathode-ray tube, or oscillation due to the sound from the speaker when the color cathode-ray tube has been built into a TV set. Particularly, when the present invention is applied to a color cathode-ray tube having an aspect ratio of 16 to 9, the curved-surface holding strength can be increased in good balance over the whole surface of the mask main body. Thus, it is possible to structure a color cathode-ray tube capable of providing satisfactory picture quality by minimizing an occurrence of howling of color purity.

When a recess is provided at the shadow mask, it is very important that the q value does not shift from the permissible range and the image of the recess, which deteriorates the image quality, is not produced on the screen.

Thus, at these portions near the short axis ends (those portions near the long sides), the radius of curvature of the mask main body in the short axis direction has a sufficient value for maintaining the curved surface holding strength, and at the other portion of the mask main body, the radius of curvature is larger than those at the short axis end portions, so that it is possible to delete an influence of the recess at a main region of the effective portion.

Moreover, it is preferable that the radius of curvature of the mask main body at the long axis end portions (short sides) in the short axis direction is larger than the radius of curvature near the short axis so that the shadow mask is seen a substantially flat in order to improve visibility. The radius of curvature of the main body at the long axis end portions in the short axis direction may be more large and may be infinity.

Particularly, in a color cathode-ray tube having an aspect ratio of 16 to 9, since the long sides are longer than normal cathode-ray tubes, it is effective that the radius of curvature of the mask main body in the short axis direction is suitably selected so as to form a recess at each long side (short axis end), and it is more preferable that the short sides are flat.

BRIEF DESCRIPTION OF DRAWINGS

FIGS. 1 to 4 show a color cathode-ray tube according to an embodiment of the present invention, in which:

FIG. 1 is a cross sectional view of the color cathode-ray tube;

FIG. 2 is a perspective view showing a mask main body of a shadow mask in the color cathode-ray tube;

FIG. 3 is a side view of the mask main body;

FIG. 4 is a cross-sectional view of the mask main body cut along line IV—IV in FIG. 2;

BEST MODE OF CARRYING OUT THE INVENTION

A color cathode-ray tube according to an embodiment of the present invention will be explained in detail with reference to the drawings.

Figure 1:
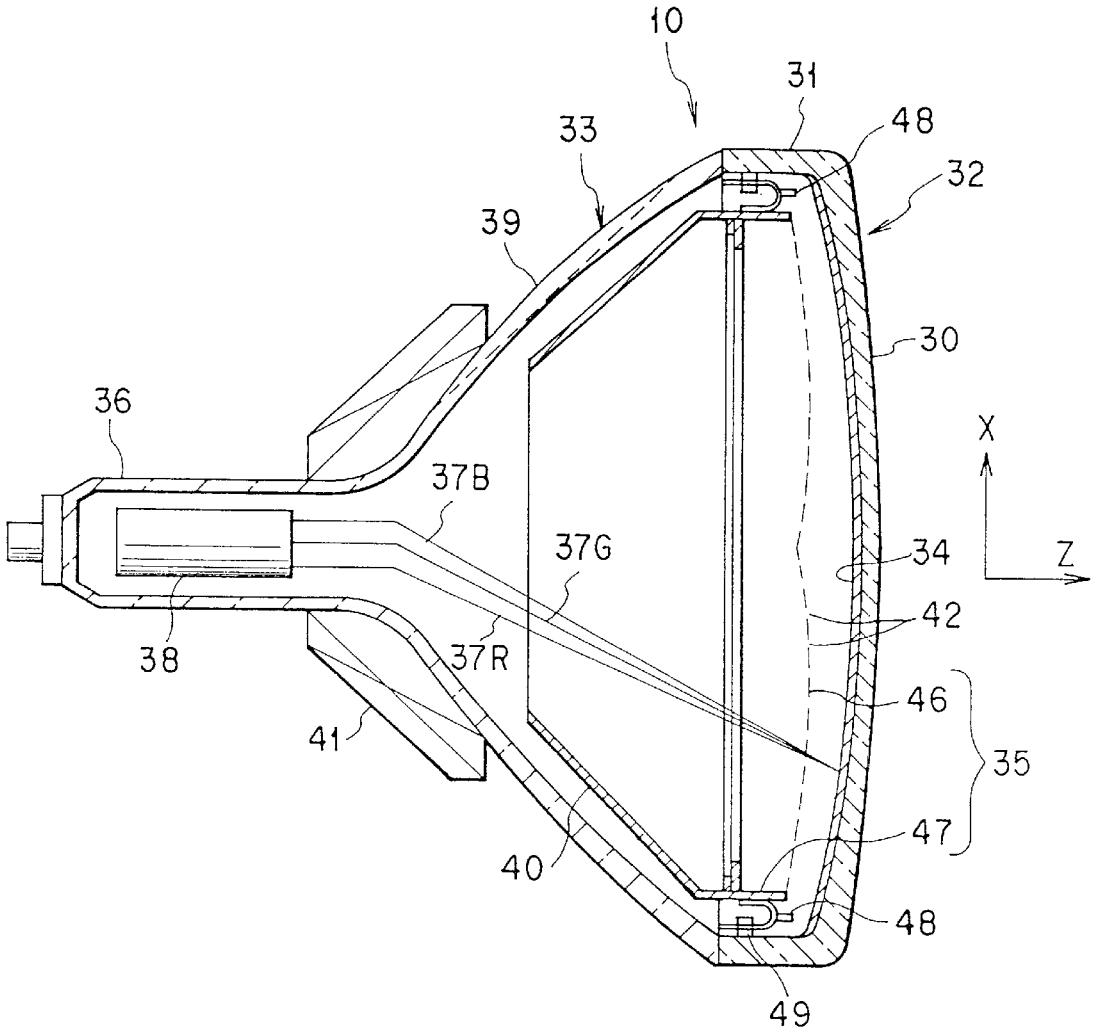

As shown in FIG. 1, a color cathode-ray tube has a vacuum envelope 10. This vacuum envelope 10 includes a substantially rectangular panel 32 having an effective portion 30 of a curved surface and a skirt portion 31 provided on the periphery of this effective portion, and a funnel 33 connected to the skirt portion. On the inner surface of the effective portion 30 of the panel 32 is formed a phosphor screen 34 including a black color non-light emitting substance layers and a three-color phosphor layers buried in gaps of the black non-light emitting substance layers. Inside the panel 32, there is disposed a substantially rectangular shadow mask 35 facing the phosphor screen 34. Within a neck 36 of the funnel 33 is arrange an electron gun 38 for emitting three electron beams. Inside a large diameter portion 39 of the funnel 33 is disposed an inner shield 40 fixed to a mask frame of the shadow mask 35.

In the color cathode-ray tube, three electron beams 37R, 37B and 37G emitted from the electron gun 38 are deflected by a magnetic field generated from a deflector 41 mounted on the outside of the funnel 33, and scan the phosphor screen both horizontally and vertically through the shadow mask, to thereby display a color image.

Figure 2:
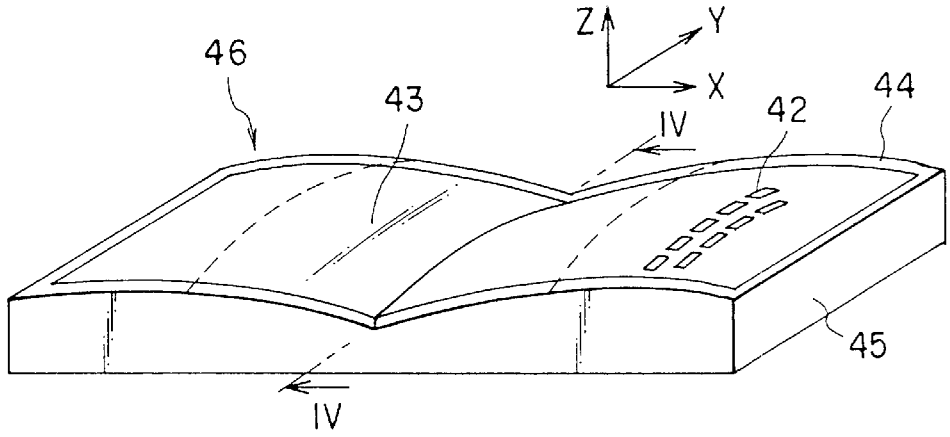
Figure 3:
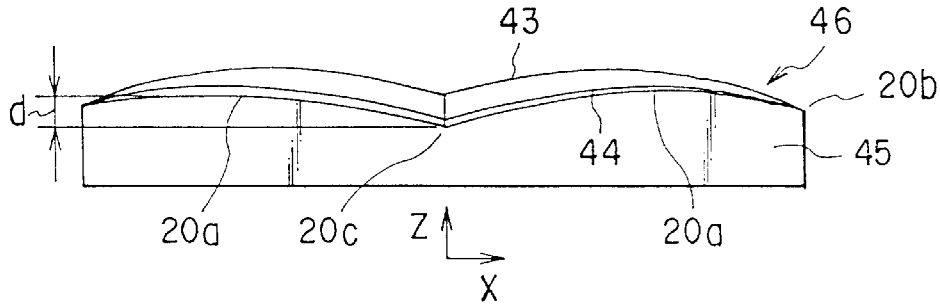

As shown in FIGS. 1 to 3, the shadow mask 35 is provided with a substantially rectangular mask main body 46 and a substantially rectangular mask frame 47 fixed to the peripheral part of the mask main body. The mask main body 46 has a long axis (a horizontal axis) X and a short axis (a vertical axis) Y that are orthogonal with each other through a tube axis Z, and is formed in a rectangular shape elongated in the long axis direction. The mask main body 46 has a substantially rectangular effective surface 43 formed with a large number of electron-beam passage apertures 42, a non-aperture portion 44 surrounding the outer periphery of this effective surface, and a skirt portion 45 formed in a bent at almost a right angle with respect to the outer periphery of the non-aperture portion. The effective surface 43 is formed in a curved surface facing the phosphor screen 34 and also in convex to the phosphor screen 34. The skirt portion 45 of the mask main body 46 is fixed to the mask frame 47. The shadow mask 35 is detachably supported by the panel 32 by engaging a wedge-shaped elastic supporting member 48 fixed to each side wall of the mask frame 47 with a stud pin 49 provided on the inner surface of the skirt portion 31 of the panel 32.

Figure 4:
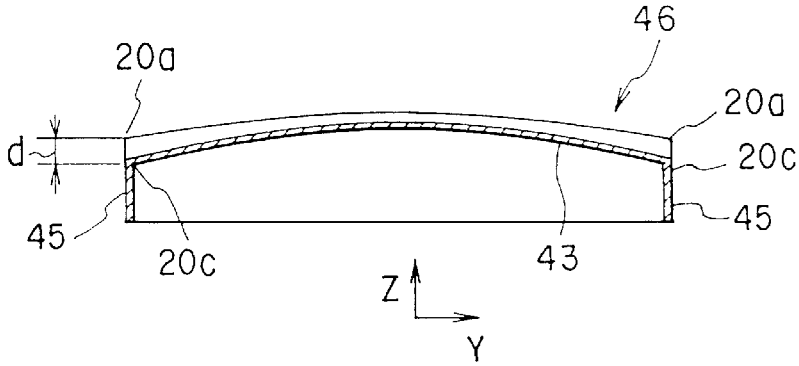

As shown in FIGS. 2 to 4, the mask main body 46 is formed to have a curved surface in such a way that the radius of curvature of the effective surface 43 and the non-aperture portion 44 in a short axis Y direction at a region near the short axis Y, that is, the radius of curvature of the cross section along the short axis Y at a region near the short axis Y, is smaller than the radius of curvature of any other part of the effective surface 43 and the non-aperture portion 44 in the short axis direction, and that this radius of curvature in the short axis direction increases with distant from the short axis Y toward the end of the long axis X, and the radius of curvature in the short axis direction becomes substantially infinite at a position of each end of the long axis X. Further, the mask main body 46 is formed such that, over the whole length in the short axis direction, a portion near the short axis Y is recessed from any other part adjacent in the long axis X direction, in a direction leaving from the phosphor screen 34 along a tube axis Z.

In FIGS. 3 and 4, on each long side of the non-aperture portion 44, the difference between the size of drop (or recess) at an intermediate part 20*a* between the short axis Y and the long axis X end, and the size of drop (or recess) at an end 20*b* of the short axis Y is shown by d. As is clear from these drawings, the effective surface 43 and the non-aperture portion 44 of the mask main body 46 have a larger size of drop at a portion near the short axis Y end 20*c* than at adjacent parts of the long side. Further, the drop size becomes larger in the order of the drop or recess at the intermediate part 20*a* of the long side, the drop at the diagonal axis end 20*b*, or the corner, and the drop at the short axis end 20*c*. The effective surface 43 and the non-aperture portion 44 have the greatest drop at a position of the short axis Y end 20*c*.

In the above structure of the mask main body 46, the drop near the short axis Y of the effective surface 43 is within a permissible range of distance (q value) between the inner surface of the effective portion 30 of the panel 32 and the effective surface 43 of the mask main body 46.

According to the above-structured color cathode-ray tube, the curved surface holding strength of the effective surface 43 can be maintained at a high level even in the case where the radius of curvature of the outer surface of the effective portion 30 of the panel 32 is increased for improving the visibility and also the radius of curvature of the effective surface 43 of the mask main body 46 is increased accordingly. Therefore, it is possible to provide a color cathode-ray tube which can reduce deterioration of color purity by restricting local deformation of the shadow mask in the process of manufacturing it, thermal deformation of the shadow mask in the process of manufacturing the color cathode-ray tube, or oscillation due to the sound from the speaker when the color cathode-ray tube has been built into a TV set.

Particularly, in the case of a color cathode-ray tube having the aspect ratio of 16:9, it has been difficult to increase the curved surface holding strength near the center of the mask main body. However, if the cathode-ray tube is structured in the manner as described above, the curved surface holding strength can be increased in good balance over the whole surface of the mask main body 43. Accordingly, for the color cathode-ray tube having the aspect ratio of 16:9, the color cathode-ray tube can also be structured to have satisfactory picture quality with minimum occurrence of deterioration of color purity.

Next, a shadow mask for a color cathode-ray tube relating to another embodiment of the present invention will be explained.

Figure 5:
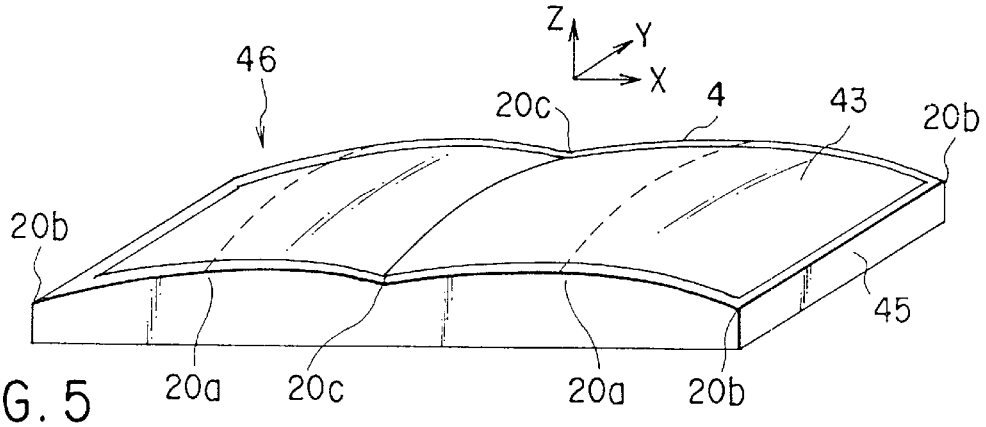
FIG. 5 is a perspective view showing a mask main body according to another embodiment of the present invention.

As shown in FIG. 5, the mask main body 46 is formed to have a curved surface in such a way that the radius of curvature of the effective surface 43 and the non-aperture portion 44 in the short axis Y direction near the short axis Y is smaller than the radius of curvature of any other part of the effective surface 43 and the non-aperture portion 44 in the short axis Y direction, and that this radius of curvature in the short axis direction increases with distant from the short axis Y toward the end of the long axis X, and the radius of curvature in the short axis direction becomes substantially infinite at a position of each end of the long axis X. Further, the mask main body 46 is formed such that a portion near the short axis Y is recessed from any other part adjacent in the long axis X direction, along a tubular axis z in a direction to leave from the phosphor screen 34.

Further, according to this embodiment, in the mask main body 46, the drop in the long sides of the effective surface 43 and the non-aperture portion 44 is large in the order of the drop at the intermediate part 20*a* in the long axis X direction, the drop at the short axis Y end 20*c*, and the drop at the diagonal axis end 20*b*. Thus, the drop volume at the diagonal axis end 20*b* is the largest, with an extreme drop at the short axis Y end 20*c*. Specifically, the diagonal axis end 20*b* is recessed at the largest so as to leave from the phosphor screen, but the drop from the long axis to the long side of the mask main body is largest at the short axis and varies largest.

According to the above-described structure, it is possible to improve the curved surface holding strength of not only the center part but also the whole of the mask main body 46.

In the above-described embodiments, it has been explained that the effective surface 43 and the non-aperture portion 44 have a curved surface with the smallest radius of curvature at the region on the short axis Y and the greatest drop volume at the short axis ends. However, the curved surface is not limited to this, and it may also be structured such that, at least at one point of the intermediate part in the long axis X direction, the radius of curvature in the short axis direction of the effective surface and the non-aperture portion is smaller than the radius of curvature of any other part, and at least one point of the intermediate part in the long axis direction of the long side of the mask main body 46 is recessed from adjacent parts.

As explained above, if the intermediate part in the long axis X direction of the long side of the mask main body is recessed from its adjacent parts, it is particularly possible to reinforce the mask part where local deformation easily occurs in the process of manufacturing a shadow mask and the process of manufacturing a color cathode-ray tube. Accordingly, it is possible to structure a color cathode-ray tube which has little problem of generating deterioration of color purity due to local deformation of the mask part or deterioration of color purity due to oscillation of a locally deformed part by the sound from a speaker after a color cathode-ray tube has been built into a TV set.

Figure 6:
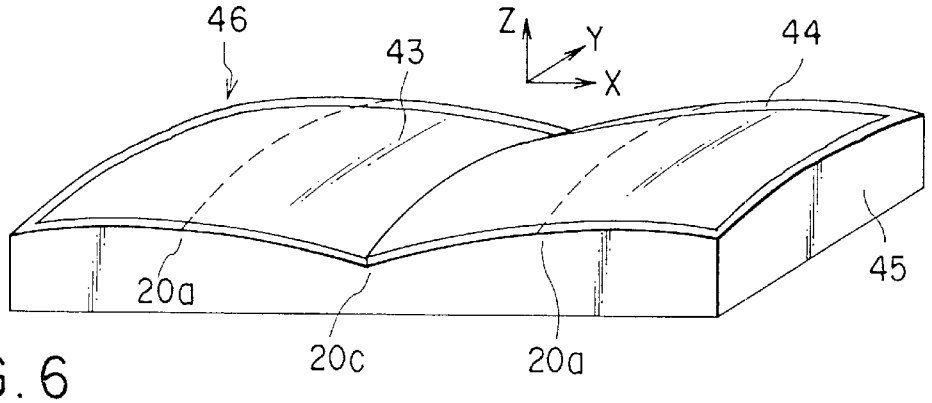
FIG. 6 is a perspective view showing a mask main body according to still another embodiment of the present invention.

Further, in the above embodiments, description has been made of the shadow mask for which the radius of curvature of the effective surface 43 and the non-aperture portion 44 in the short axis Y direction at the long axis X ends is substantially infinite. However, in the present invention, it is also possible to obtain the same effect as that of the above-described embodiments, even when the present invention is applied to a shadow mask wherein the effective surface 43 and the non-aperture portion 44 are formed of a curved surface whose radius of curvature in the short axis Y direction at the long axis X ends is limited, as shown in FIG. 6.

Figure 7:
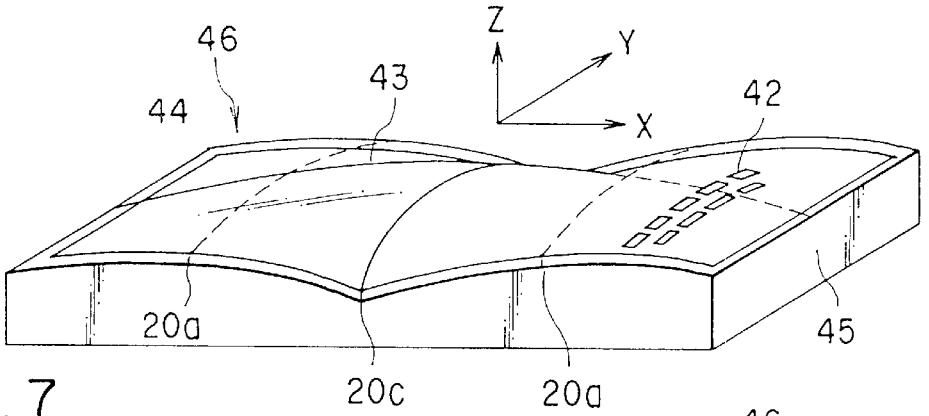
FIG. 7 is a perspective view showing a mask main body according to still another embodiment of the present invention.
Figure 8:
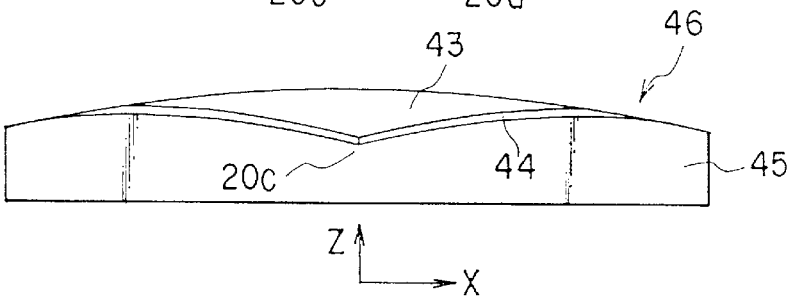
FIG. 8 is a side view showing the mask main body of FIG. 7.

Further, according to the present invention, the mask main body 46 may also be structured in a curved surface as illustrated in FIGS. 7 and 8. In other words, according to this embodiment, the radius of curvature of the effective surface 43 and the non-aperture portion 44 of the mask main body 46 in a short axis direction near the short axis Y is smaller than the radius of curvature in the short axis direction at any other part, and at each long side, a part near the short axis Y end 20*c* is recessed from adjacent parts. However, the center part of the effective surface 43 is more convex toward the phosphor screen than any other part in the long axis X direction. When the mask main body 46 having the above-described structure is used, the same effect as in the previously described embodiments can also be obtained. Further, even when the center part of the effective surface 43 is in the same plane as any other part in the long axis X direction, the same effect as in the previously described embodiments can also be obtained.

The present invention is not limited to the above-described embodiments, but can also be modified within the scope of the invention. For example, although the mask main body has been explained to have a structure provided with a similar recess in each long side of the effective surface and the non-aperture portion, the structure is not limited to this. It may also be structured such that the effective surface has a curved surface having a curvature in a short axis direction independent of the non-aperture portion, and a recess is formed at each long side of the effective surface or each long side of the non-aperture portion. In this case, an effect similar to that of the above-described embodiments can also be obtained.

INDUSTRIAL APPLICABILITY

As described above in detail, according to the color cathode-ray tube having the above-described structure, the provision of a recess on each of the long sides of the effective surface or the non-aperture portion of the mask main body makes it possible to maintain high-level strength for holding the curved surface of the effective surface of the mask main body even in the case where the radius of curvature of the effective surface of the mask main body has been increased along an increase in the radius of curvature of the external surface of the effective portion of the panel. Therefore, it is possible to provide a color cathode-ray tube which can minimize an occurrence of deterioration of color purity by restricting local deformation of a shadow mask in the process of manufacturing the shadow mask, thermal deformation of the shadow mask in the process of manufacturing the color cathode-ray tube, or oscillation due to the sound from the speaker when the color cathode-ray tube has been built into a TV set. Particularly, when the present invention is applied to a color cathode-ray tube having an aspect ratio of 16 to 9, the curved-surface holding strength can be increased in good balance over the whole surface of the mask main body. Thus, it is possible to structure a color cathode-ray tube capable of providing satisfactory picture quality by minimizing an occurrence of howling of color purity.

What is claimed is:

1. A color cathode-ray tube, comprising:

a vacuum envelope including a panel having a substantially rectangular effective portion, a funnel connected to the panel, and a phosphor screen formed on an inner surface of the effective portion of the panel;

a shadow mask disposed within the vacuum envelope to face the phosphor screen, the shadow mask including a substantially rectangular mask main body having a curved effective surface formed with a large number of electron-beam passage apertures and facing the phosphor screen, a non-aperture portion surrounding an outer periphery of the effective surface, and a skirt portion formed in a bent on an outer periphery of the non-aperture portion; and a substantially rectangular mask frame fixed to the skirt portion of the mask main body; and an electron gun disposed within a neck of the funnel for emitting electron beams to the phosphor screen through the shadow mask;

the mask main body having a long axis extending in a horizontal direction and crossing with a tube axis, and a short axis extending in a vertical direction and crossing with both the tube axis and the long axis, and the effective surface, or the effective surface and the non-aperture portion of the mask main body being formed in a curved surface which is convex to the phosphor screen and has a radius of curvature in the short axis direction, and at each long side of the mask main body, an end portion of the short axis of the effective surface or the non-aperture portion is recessed from any other adjacent part, in a direction leaving from the phosphor screen along the tube axis, at each long side of the mask main body, the recess at the part of the short axis end of the effective surface or the non-aperture portion being larger than the recess at other parts.

2. A color cathode-ray tube according to claim 1, wherein the radius of curvature of the effective surface, or the effective surface and the non-aperture portion of the mask main body, in the short axis direction near the short axis is smaller than the radius of curvature in the short axis direction at other parts.

3. A color cathode-ray tube according to claim 2, wherein the radius of curvature in the short axis direction of the effective surface and the non-aperture portion increases with distant from the short axis toward a part of the long axis X end, and the radius of curvature in the short direction at parts of the long axis X ends becomes substantially infinite.

4. A color cathode-ray tube according to claim 1, wherein the center part of the effective surface is more convex toward the phosphor screen than other parts adjacent in the long axis direction.

5. A color cathode-ray tube according to claim 1, wherein the center part of the effective surface is in a same plane as other parts adjacent in the long axis X direction.

6. A color cathode-ray tube, comprising:

a vacuum envelope including a panel having a substantially rectangular effective portion, a funnel connected to the panel, and a phosphor screen formed on an inner surface of the effective portion of the panel;

a shadow mask disposed within the vacuum envelope to face the phosphor screen, the shadow mask including a substantially rectangular mask main body having a curved effective surface formed with a large number of electron-beam passage apertures and facing the phosphor screen, a non-aperture portion surrounding an outer periphery of the effective surface, and a skirt portion formed in a bent on an outer periphery of the non-aperture portion; and a substantially rectangular mask frame fixed to the skirt portion of the mask main body; and an electron gun arranged within a neck of the funnel for emitting electron beams to the phosphor screen through the shadow mask;

the mask main body having a long axis extending in a horizontal direction and crossing with a tube axis, and a short axis extending in a vertical direction and crossing with both the tube axis and the long axis, and the effective surface, or the effective surface and the non-aperture portion of the mask main body being formed in a curved surface which is convex to the phosphor screen and has a radius of curvature in the short axis direction, and at each long side of the mask main body, at least one part of an intermediate portion in the long axis direction of the effective surface or the non-aperture portion is recessed from any other adjacent part, in a direction leaving from the phosphor screen along the tube axis, at each long side of the mask main body, the recess at the part of the short axis end of the effective surface or the non-aperture portion being larger than the recess at other parts.

7. A color cathode-ray tube according to claim 6, wherein the radius of curvature of the effective surface, or the effective surface and the non-aperture portion of the mask main body, in the short axis direction near the short axis is smaller than the radius of curvature in the short axis direction at other parts.

8. A color cathode-ray tube, comprising:

a vacuum envelope including a panel having a substantially rectangular effective portion, a funnel connected to the panel, and a phosphor screen formed on an inner surface of the effective portion of the panel, a shadow mask disposed within the vacuum envelope to face the phosphor screen, the shadow mask including a substantially rectangular mask main body having a curved effective surface formed with a large number of electron-beam passage apertures and facing the phosphor screen, a non-aperture portion surrounding an outer periphery of the effective surface, and a skirt portion formed in a bent on an outer periphery of the non-aperture portion; and a substantially rectangular mask frame fixed to the skirt portion of the mask main body; and an electron gun arranged within a neck of the funnel for emitting electron beams to the phosphor screen through the shadow mask;

the mask main body having a long axis extending in a horizontal direction and crossing with a tube axis, and a short axis extending in a vertical direction and crossing with both the tube axis and the long axis, and the effective surface, or the effective surface and the non-aperture portion of the mask main body being formed in a curved surface which is convex to the phosphor screen and has a radius of curvature in the short axis direction, and at each long side of the mask main body, at least one part of the effective surface and the non-aperture portion is recessed, near the short axis, from any other part adjacent in the long axis direction, in a direction leaving from the phosphor screen along the tube axis, at each long side of the mask main body, the recess at the part of the short axis end of the effective surface or the non-aperture portion being larger than the recess at other parts.

9. A color cathode-ray tube, comprising:

a vacuum envelope including a panel having a substantially rectangular effective portion, a funnel connected to the panel, and a phosphor screen formed on an inner surface of the effective portion of the panel;

a shadow mask disposed within the vacuum envelope to face the phosphor screen, the shadow mask including a substantially rectangular mask main body having a curved effective surface formed with a large number of electron-beam passage apertures and facing the phosphor screen, a non-aperture portion surrounding an outer periphery of the effective surface, and a skirt portion formed in a bent on an outer periphery of the non-aperture portion; and a substantially rectangular mask frame fixed to the skirt portion of the mask main body; and an electron gun disposed within a neck of the funnel for emitting electron beams to the phosphor screen through the shadow mask;

the mask main body having a long axis extending in a horizontal direction and crossing with a tube axis, and a short axis extending in a vertical direction and crossing with both the tube axis and the long axis, and the effective surface, or the effective surface and the non-aperture portion of the mask main body being formed in a curved surface which is convex to the phosphor screen and has a radius of curvature in the short axis direction, and at each long side of the mask main body, an end portion of the short axis of the effective surface or the non-aperture portion is recessed from any other adjacent part, in a direction leaving from the phosphor screen along the tube axis, at both ends of each long side of the mask main body, the effective surface or the non-aperture portion being recessed along the tube axis direction in a direction leaving from the phosphor screen, and a recess of the effective surface or the non-aperture portion at a part of the short axis end being smaller than the drop at the ends of the long side.

* * * * *